US006102048A

United States Patent [19]

Baker

[11] Patent Number: 6,102,048

[45] Date of Patent: Aug. 15, 2000

[54] FINGERNAIL MANICURING INSTRUMENT

[76] Inventor: Oleda Baker, 717 Verna Trail North, Fort Worth, Tex. 76108

[21] Appl. No.: 09/298,083

[22] Filed: Apr. 22, 1999

[51] Int. Cl.[7] ..... A45D 29/18; A45D 29/00

[52] U.S. Cl. ..... 132/76.4; 132/73; 132/73.5; 132/75.6

[58] Field of Search ..... 132/73, 73.5, 75.6, 132/76.4; 451/461, 557, 524, 538, 552

[56] References Cited

U.S. PATENT DOCUMENTS

| | | | |
|---|---|---|---|
| D. 291,930 | 9/1987 | Kilman et al. | D28/59 |
| D. 373,855 | 9/1996 | Jurosek-Bland | D28/59 |
| 1,780,072 | 10/1930 | Putrell | 132/76.4 |
| 3,298,381 | 1/1967 | Adams | 132/76.4 |
| 4,292,987 | 10/1981 | Alley | 132/73 |
| 4,930,529 | 6/1990 | Whitney | 132/73 |
| 5,163,455 | 11/1992 | Pointe et al. | 132/76.4 |
| 5,439,013 | 8/1995 | Hoover | 451/557 |
| 5,588,453 | 12/1996 | Fraysher | 132/76.4 |
| 5,996,590 | 12/1999 | Steege | 132/76.4 |

*Primary Examiner*—Gene Mancene
*Assistant Examiner*—Pedro Philogene
*Attorney, Agent, or Firm*—Dunlap, Codding & Rogers, P.C.

[57] ABSTRACT

An instrument and method for manicuring the underside of natural, artificial and acrylic fingernails. The instrument comprises a shaft member having a first end and a second end, and an abrasive member connected to at least one of the first and second ends of the shaft member. The abrasive member having a substantially arcuate shaped abrading surface for permitting at least a portion of the abrasive member to be positioned for abrading engagement with the underside of the fingernail to file and hone the underside of the nail.

20 Claims, 2 Drawing Sheets

FINGERNAIL MANICURING INSTRUMENT

CROSS-REFERENCE TO RELATED APPLICATIONS

Not applicable.

STATEMENT REGARDING FEDERALLY-SPONSORED RESEARCH OR DEVELOPMENT

Not applicable.

BACKGROUND OF THE INVENTION

1. Field of Invention

The present invention relates to fingernail hygiene, and more particularly, but not by way of limitation, to an improved finger-nail instrument for manicuring and honing the underside of fingernails.

2. Description of Related Art

Nail files are commonly constructed with an abrasive surface for honing uneven or rough portions of the nail. These nail files are useful for quickly and easily trimming and filing the ends of the nail and for smoothing the upper surfaces.

Artificial and acrylic nails are popularly used as alternatives to natural nails. When applying acrylic nails, an artificial nail tip is bonded to the outer edge of the natural nail so that the artificial nail extends outwardly therefrom. Once the bonding material dries, liquid acrylic is applied to the upper exposed surface of the natural nail, as well as the artificial nail, creating a substantially elongated uniform upper nail surface. When the acrylic material hardens, the nail requires extensive filing to smooth uneven portions on the upper exposed nail surface and often the underside of the nail because of excess glue as well as an uneven binding.

Also, the underside of the nail often becomes rough, dirty, and discolored both where the artificial nail extends outwardly from the natural nail, as well as, under the natural nail itself. Therefore, the underside of the nail requires extensive filing and smoothing as well as periodic manicuring thereafter. Similar reasoning exists for manicuring the underside of natural nails.

Presently, most manicuring devices employ a standard emery board to hone and shape the exposed upper surfaces of natural and acrylic nails. Prior art devices capable of filing the fingernail are known in the art; however, these devices are not conducive to filing under the nail, are unable to clean or reach deep under the nail, and are inappropriately shaped to file the underside of the fingernail effectively.

Also, professional manicurists utilize motorized manicuring machines which employ grinding stones of specific design for reaching and honing the undernail area. However, these professional machines are expensive, cumbersome, and require a power-supply which makes remote transport and use impractical.

Accordingly, a need exists for an improved fingernail manicuring instrument for manicuring and honing the underside of fingernails which is readily portable, inexpensive, and capable of reaching deep within the undernail area. It is to such a fingernail manicuring instrument that the present invention is directed.

SUMMARY OF THE INVENTION

The present invention relates generally to an instrument for manicuring the underside of fingernails. It is to be understood that the term "fingernails" as used herein includes natural, artificial, and acrylic fingernails.

Broadly, the fingernail manicuring instrument of the present invention comprises a shaft member having a first end, a second end, and an abrasive member connected to at least one of the first and second ends of the shaft member. The abrasive member, which is sized and dimensioned so that at least a portion of the abrasive member is positionable adjacent a portion of the underside of a fingernail, is provided with an arcuate-shaped abrasive surface which substantially corresponds with at least a portion of the arcuate-shape of the underside of the fingernail. More specifically, the abrasive member is provided with a substantially elliptical cross-section and a pointed distal end so as to permit placement of the abrasive member underneath an outwardly extending portion of the fingernail and thereby permit abrasive engagement of the abrasive member with the underside of the fingernail to hone and file the underside of the fingernail.

In one embodiment, the fingernail manicuring instrument of the present invention comprises a first abrasive member connected to the first end of the shaft member and a second abrasive member connected to the second end of the shaft member. One of the first and second abrasive members is provided with a substantially teardrop shape having a substantially elliptical cross-sectional configuration, and the other of the first and second abrasive members is provided with a substantially conical shape having a substantially elliptical cross-sectional configuration.

An object of the present invention is to provide an improved instrument for manicuring and honing the underside of fingernails which is capable of reaching deep within the undernail area.

Another object of the present invention, while achieving the before-stated object, is to provide an improved instrument for manicuring and honing the underside of fingernails which is readily portable, inexpensive, and easy to use.

Other advantages and features of the present invention will become apparent to those skilled in the art from the following detailed description when read in conjunction with the drawings and the appended claims.

DETAILED DESCRIPTION

Figure 1:
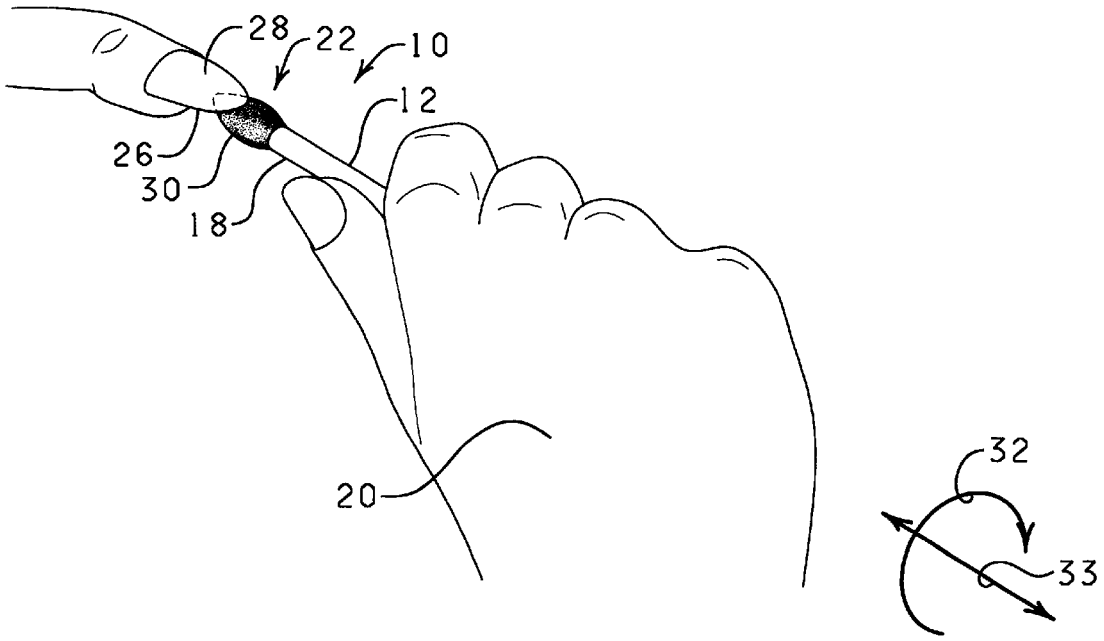
FIG. 1 is a pictorial representation of a fingernail manicuring instrument of the present invention illustrating the positioning of an abrasive member thereof underneath a fingernail for filing and honing the underside of the fingernail.

Referring now to the drawings, and in particular to FIG. 1, shown therein is a fingernail manicuring instrument 10 constructed in accordance with the present invention. The fingernail manicuring instrument 10 comprises a shaft member 12 having a first end 14, a second end 16 (FIGS. 2 and 3) and an outer peripheral surface 18. The shaft member 12, which is substantially rigid, can be constructed of any material, such as wood, metal, polymeric materials, ceramic materials, porcelain materials, and the like.

The shaft member 12 is illustrated as an elongated member having a generally cylindrical cross-sectional configuration. However, it should be understood that the shaft member 12 may have any desired cross-sectional configuration, such as oval, square, or any other such configurations provided the shaft member 12 is easily graspable by a person, such as by a person's hand 20 as illustrated in FIG. 1. That is, the outer peripheral surface 18 of the shaft member 12 is desirably provided with a comfortable surface for grasping and manipulating the fingernail manicuring instrument 10 by the person's hand 20.

Figure 2:
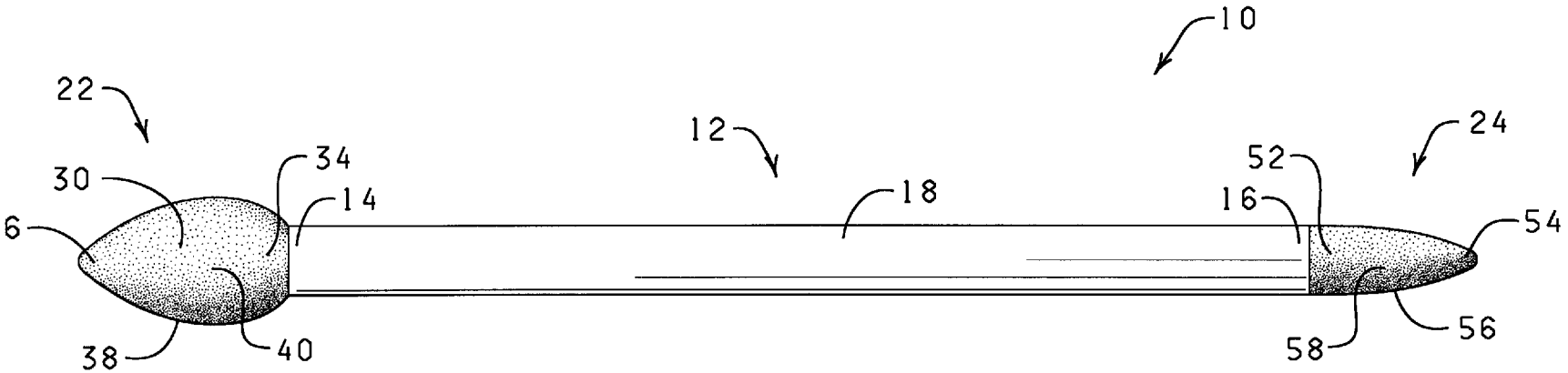
FIG. 2 is a top plan view of the fingernail manicuring instrument of the present invention.
Figure 3:
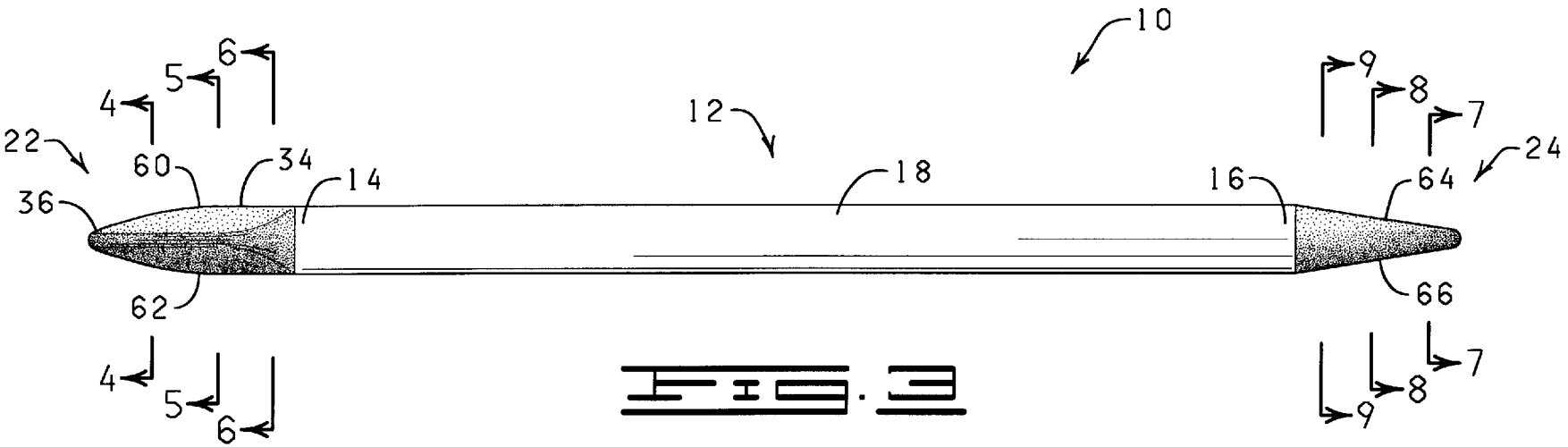
FIG. 3 is a side elevational view of the fingernail manicuring instrument of the present invention.

Referring now to FIGS. 2 and 3, in combination with FIG. 1, the fingernail manicuring instrument 10 further comprises a first abrasive member 22 connected to the first end 14 of the shaft member 12 and a second abrasive member 24 connected to the second end 16 of the shaft member 12. The first abrasive member 22, which is sized and dimensioned so that at least a portion of the first abrasive member is positionable adjacent a portion of the underside 26 of a fingernail 28 substantially as shown in FIG. 1, is provided with an arcuate-shaped abrasive surface 30 which substantially corresponds with at least a portion of the arcuate-shape of the underside 26 of the fingernail 28.

Thus, the first abrasive member 22 has a substantially elliptical cross-section so as to permit placement of the first abrasive member 22 underneath an outwardly extending portion of the fingernail 28. The configuration of the first abrasive member 22 thus permits at least a portion of the first abrasive member 22 to abrasively engage and manicure (i.e. hone and file) the underside 26 of the fingernail 28 in response to movement of the shaft member 12 imparted upon the shaft member 12 by the person's hand 20. That is, filing and honing of the underside 26 of the fingernail 28 can be maximized by imparting either a vertical movement, or a circular movement indicated by the arrow 32 upon the shaft member 12 (FIG. 1), or by imparting a horizontal movement indicated by the arrow 33 relative to the fingernail 28 upon the shaft member 12 (FIG. 1), or by a combination of circular movement, horizontal movement, and/or vertical movement, or any other movement capable of imparting a filing and honing action to the underside 26 of the fingernail 28.

Figure 6:
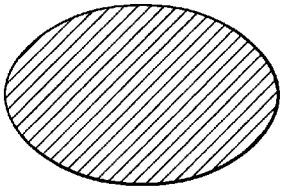
FIG. 6 is a cross-sectional view of the first abrasive member of the fingernail manicuring instrument of FIG. 3 taken along 6—6 thereof.

Referring more specifically to FIGS. 2 and 3, the first abrasive member 22, which is illustrated as having a substantially teardrop configuration, is further characterized as having a base portion 34, a distal end 36, an outer peripheral surface 38 and a substantially elliptical crosssection (FIG. 6), the purpose of which will be described in more detail hereinafter.

The first abrasive member 22 is connected to the first end 14 of the shaft member 12 with a bonding material so as to permanently attach the first abrasive member 22 to the first end 14 of the shaft member 12. The bonding material may be any of a variety of commercially available bonding materials capable of bondingly connecting the first abrasive member 22 to the first end 14 of the shaft member 12 so as to provide a permanent bond therebetween.

Alternatively, the first abrasive member 22 may have a female portion which matingly receives a male portion. The first end 14 of the shaft member 12 includes a male portion which in combination with bonding material bondingly attaches the first abrasive member 22 with the shaft member 12. It should also be understood that the first abrasive member 22 may be integrally formed from a portion of the shaft member 12. In such construction, the first abrasive member 22 may be formed from the first end 14 of the shaft member 12 such that the first abrasive member 22 is of substantially tear drop configuration. Other configurations for permanently attaching the first abrasive member 22 to the first end 14 of the shaft member 12 may be employed for the present purposes.

The first abrasive member 22 is provided with the outer peripheral surface 38 having an abrasive material 40 disposed thereon. The abrasive material 40, such as emery or other material of an abrasive composition, is bondingly disposed on the outer peripheral surface 38 of the first abrasive member 22. The abrasive material 40 may comprise fine, medium, or coarse emery granules such as sand or other abrasive compounds which may be fixed to the outer peripheral surface 38.

The first abrasive member 22 may also be formed of a substantially uniform and solid abrasive material. In such construction, the first abrasive member 22 is formed of a substantially uniform abrasive material such that the substantially uniform abrasive material may comprise varying grades of coarseness.

The second abrasive member 24 of substantially conical configuration is connected to the second end 16 of the shaft member 12. The second abrasive member 24 has a base portion 52, a distal end 54, and an outer peripheral surface 56. The second abrasive member 24 has a substantially elliptical cross-sectional configuration which will be further described hereinafter.

The second abrasive member 24 is connected to the second end 16 of the shaft member 12 with a bonding material so as to permanently attach the second abrasive member 24 to the second end 16 of the shaft member 12. The bonding material may be any of a variety of commercially available bonding materials capable of bondingly connecting the second abrasive member 24 to the second end 16 of the shaft member 12 so as to provide a permanent bond therebetween.

Alternatively, the second abrasive member 24 may have a female portion which matingly receives a male portion. The second end 16 of the shaft member 12 includes a male portion which in combination with bonding material bondingly attaches the second abrasive member 24 with the shaft member 12. It should also be understood that the second abrasive member 24 may be integrally formed from a portion of the shaft member 12. In such construction, the second abrasive member 24 may be formed from the second end 16 of the shaft member 12 such that the second abrasive member 24 is of substantially conical configuration. Other configurations for permanently attaching the second abrasive member 24 to the second end 16 of the shaft member 12 may be employed for the present purposes.

The second abrasive member 24 is provided with an outer peripheral surface 56 having an abrasive material 58 disposed thereon. The abrasive material 58, such as emery or other material of an abrasive composition, is bondingly disposed on the outer peripheral surface 56 of the second abrasive member 24. The abrasive material 58 may comprise fine, medium, or coarse emery granules such as sand or other abrasive compounds which may be fixed to the outer peripheral surface 56.

The second abrasive member 24 may be formed of a substantially uniform and solid abrasive material. In such construction, the second abrasive member 24 is formed of a substantially uniform abrasive material such that the substantially uniform abrasive material may comprise varying grades of coarseness.

Referring now to FIG. 3, it can be seen that the first abrasive member 22 and the second abrasive member 24 are both of substantially elliptical cross-sectional configuration. The first abrasive member 22 is of substantially tear drop configuration and is provided with an upper side 60 and a lower side 62. The first abrasive member 22 is shown having a curvature along the upper side 60 whereby the base portion 34 is raised relative to the distal end 36. This curved design along the upper side 60 of the first abrasive member 22 is provided to conform to the underside 26 of the fingernail 28 such that abrasive material 40 applied to the outer peripheral surface 38 formingly contacts the contoured undernail area.

Figure 4:
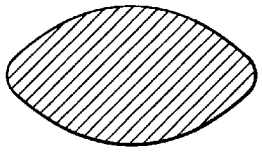
FIG. 4 is a cross-sectional view of a first abrasive member of the fingernail manicuring instrument of FIG. 3 taken along 4—4 thereof.

Thus, it can be appreciated that the substantially tear drop configuration of the first abrasive member 22 promotes contact of the undernail with the maximum surface area of the abrasive material 40 disposed on the outer peripheral surface 38 for manicuring the undernail area. Due to the symmetrical nature of the upper side 60 with respect to the lower side 62 of the first abrasive member 22, the tear drop configuration allows the distal end 36 of the first abrasive member 22 to extend a maximum distance into the undernail area since the lower side 62 of the distal end 36 is similarly curved and therefore produces a low profile. The low profile of the distal end 36 allows optimum reach into the undernail area without the reach being impeded by the tip of the finger which provides for the maximum penetration into the depth of the undernail area (FIG. 4).

Figure 5:
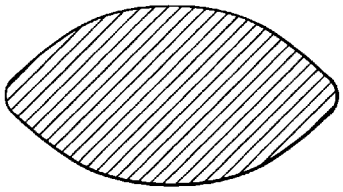
FIG. 5 is a cross-sectional view of the first abrasive member of the fingernail manicuring instrument of FIG. 3 taken along 5—5 thereof.

Such construction of the distal end 36 produces improved undernail honing and manicuring since the distal end 36 continues to promote contact of the abrasive material 40 applied on the outer peripheral surface 38 with the underside 26 of the fingernail 28. However, the base portion 34 of the upper side 60 is shown to be more elliptically rounded (FIGS. 5 and 6) as the base portion 34 extends nearer the first end 14 of the shaft member 12 where the first abrasive member 22 is connected to the shaft member 12. The increasing curvature arc of the rounded outer peripheral surface 38 of the first abrasive member 22 at the base portion 34 promotes contact of the abrasive material 40 the outer peripheral surface 38 for abrading engagement with similar arcuate curvature of the underside 26 of the fingernail 28.

Thus, it can be seen that the gradual shallowing of the elliptical cross-section of the first abrasive member 22 as it extends from its most rounded configuration near the base portion 34 (FIG. 6) to its most elliptically shallow arc nearest the distal end 36 (FIG. 4) increases the versatility of the first abrasive member 22 for both reaching the depths of the undernail area and promoting forming contact of the first abrasive member 22 with the underside 26 of the fingernail 28 for honing and manicuring purposes.

The second abrasive member 24 is substantially conically-shaped and is provided with an upper side 64 and a lower side 66. The second abrasive member 24 is shown having a curvature along the outer peripheral surface 56, along the upper side 64 whereby the base portion 52 is raised relative to the distal end 54. This curved design along the upper side 64 of the second abrasive member 24 is provided to conform with the underside 26 of the fingernail 28, such that the abrasive material 58 applied thereon to the outer peripheral surface 56 formingly contacts the contoured undernail area.

Thus, it can be appreciated that the substantially conical configuration of the second abrasive member 24 promotes contact of the undernail with the maximum surface area of the outer peripheral surface 56, causing the abrasive material 58 disposed thereon to abradingly engage the undernail area. Due to the symmetrical nature of the upper side 64 with respect to the lower side 66 of the second abrasive member 24, the conical configuration allows the distal end 54 of the second abrasive member 24 to extend the maximum distance into the undernail area, since the lower side 66 of the distal end 54 is similarly curved and therefore produces a low profile. The low profile of the distal end 54 allows optimum reach into the undernail area without the reach being impeded by the tip of the finger.

Figure 7:
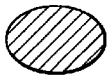
FIG. 7 is a cross-sectional view of a second abrasive member of the fingernail manicuring instrument of FIG. 3 taken along 7—7 thereof.
Figure 8:
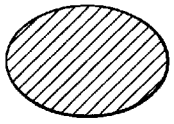
FIG. 8 is a cross-sectional view of the second abrasive member of the fingernail manicuring instrument of FIG. 3 taken along 8—8 thereof.
Figure 9:
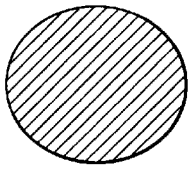
FIG. 9 is a cross-sectional view of the second abrasive member of the fingernail manicuring instrument of FIG. 3 taken along 9—9 thereof.

It can be seen that the conical configuration of the distal end 54 of the second abrasive member 24 maintains a substantially elliptical cross-sectional configuration (FIG. 7). Such construction of the distal end 54 produces improved undernail honing and manicuring since the distal end 54 continues to promote contact of the abrasive material 58 applied on the outer peripheral surface 56 with the underside 26 of the fingernail 28. However, the base portion 52 of the upper side 64 is shown to be more elliptically rounded (FIGS. 8 and 9), as the base portion 52 extends nearer the second end 16 of the shaft member 12 where the second abrasive member 24 is connected to the shaft member 12. The increasing curvature arc of the rounded outer peripheral surface 56 of the second abrasive member 24 near the base portion 52 promotes contact of the abrasive material 58 disposed on the outer peripheral surface 56 for abrading engagement with the similar arcuate curvature of the underside 26 of the fingernail 28.

It can be seen that the gradual shallowing of the elliptical cross-section of the second abrasive member 24 as it extends from the most rounded configuration near the base portion 52 (FIG. 9) to its most elliptically shallow arc nearest the distal end 54 (FIG. 7) increases the versatility of the second abrasive member 24 for both reaching the depths of the undernail area and promoting forming contact of the second abrasive member 24 with the underside 26 of the fingernail 28 for honing and manicuring purposes.

In another aspect, the abrasive material 40 disposed on the outer peripheral surface 38 of the first abrasive member 22 may be more coarse with larger abrasive particles relative to the less coarse abrasive material 58 disposed on the outer peripheral surface 56 of the second abrasive member 24. In another aspect, the abrasive material 40 disposed on the outer peripheral surface 38 of the first abrasive member 22 may be less coarse with smaller abrasive particles relative to the more coarse abrasive material 58 disposed on the outer peripheral surface 56 of the second abrasive member 24. In another aspect, the abrasive material 40 disposed on the outer peripheral surface 38 of the first abrasive member 22 may be of similar coarseness relative to the abrasive material 40 disposed on the outer peripheral surface 56 of the second abrasive member 24.

In manicuring the underside 26 of the fingernail 28, the manicuring instrument 10 is positioned underneath an outwardly extending portion of the fingernail 28. Upon movement of the shaft member 12, the first abrasive member 22 abrasively engages the underside 26 of the fingernail 28 to hone and file the underside 26 of the fingernail 28. The manicuring instrument 10 is positioned such that either the first abrasive member 22 or second abrasive member 24 is placed adjacent the underside 26 of the fingernail 28 such that either the first abrasive member 22 abradingly engages the underside 26 of the fingernail 28. Thereafter, a movement must be imparted to the shaft member 12, causing the first abrasive member 22 to engage the underside 26 of the fingernail 28, thereby providing an abrasive action on the underside 26 of the fingernail 28.

The filing and honing of the underside 26 of the fingernail 28 is maximized by imparting the circular movement indicated by the arrow 32 upon the shaft member 12. Such circular movement causing the outer peripheral surface 38 of the first abrasive member 22 to abradingly engage the underside 26 of the fingernail 28. The circular movement allows the substantially arcuate shaped first abrasive member 22 to conform to the arcuate shaped underside 26 of the fingernail 28.

By imparting vertical movement and/or horizontal movement indicated by the arrow 33 relative to the fingernail 28 upon the shaft member 12, the second abrasive member 24 may be caused to reach the depths of the undernail area. Such vertical movement and/or horizonal movement imparted upon the shaft member 12 causes the outer peripheral surface 56 of the second abrasive member 24 to abradingly engage deep under the fingernail 28 for filing and honing. The manicuring instrument 10 can then be removed so that the first abrasive members 22 is no longer in contact with the underside 26 of the fingernail 28.

From the above description, it is clear that the present invention is well adapted to carry out the objects, and obtain the advantages mentioned herein, as well as those inherent in the invention. While a presently preferred embodiment of the invention has been described for the purposes of this disclosure, it will be understood that numerous changes may be made which will readily suggest themselves to those skilled in the art and which are accomplished within the spirit of the invention disclosed and as defined in the appended claims.

What is claimed is:

1. An instrument for honing and filing an underside portion of a fingernail, comprising:

a shaft member having a first end and a second end;

an abrasive member connected to at least one of the first and second ends of the shaft member, the abrasive member having a substantially arcuate shaped abrading surface sized and dimensioned for permitting at least a portion of the abrasive member to be positioned for abrading engagement with the underside of the fingernail so as to hone and file the underside of the fingernail.

2. The instrument of claim 1 wherein the abrasive member is provided with a substantially conical configuration.

3. The instrument of claim 1 wherein the abrasive member is provided with a substantially teardrop configuration.

4. An instrument for manicuring fingernails, comprising:

a shaft member having a first end and a second end;

a first substantially conically shaped abrasive member connected to the first end of the shaft member, the first substantially conically shaped abrasive member having a substantially elliptical cross-sectional configuration; and a second substantially teardrop shaped abrasive member connected to the second end of the shaft member, the second substantially teardrop shaped abrasive member having a substantially elliptical cross-sectional configuration.

5. The instrument of claim 4 wherein the first and second abrasive members are each provided with an outer peripheral surface having an abrasive material disposed thereon, the abrasive material being of substantially similar grade of coarseness.

6. The instrument of claim 4 wherein the first abrasive member is provided with an abrasive material of a different grade of coarseness than the abrasive material provided on the second abrasive member.

7. The instrument of claim 4 wherein the first and second abrasive members are each formed of a substantially uniform abrasive material of similar grade of coarseness.

8. The instrument of claim 4 wherein the first abrasive member is formed of a substantially uniform abrasive material of a different grade of coarseness than the grade of coarseness of the substantially uniform abrasive material of the second abrasive member.

9. An instrument for manicuring fingernails, comprising:

a shaft member having a first end and a second end;

a first abrasive member connected to the first end of the shaft member; and a second abrasive member connected to the second end of the shaft member, wherein the first and second abrasive members are provided with substantially conical configurations having substantially elliptical cross-sectional configurations.

10. The instrument of claim 9 wherein the first and second abrasive members are each provided with an outer peripheral surface having an abrasive material disposed thereon, the abrasive material being of substantially similar grade of coarseness.

11. The instrument of claim 9 wherein the first abrasive member is provided with an abrasive material of a different grade of coarseness than the abrasive material provided on the second abrasive member.

12. The instrument of claim 9 wherein the first and second abrasive members are each formed of a substantially uniform abrasive material of similar grade of coarseness.

13. The instrument of claim 9 wherein the first abrasive member is formed of a substantially uniform abrasive material of a different grade of coarseness than the grade of coarseness of the substantially uniform abrasive material of the second abrasive member.

14. An instrument for manicuring fingernails, comprising:

a shaft member having a first end and a second end;

a first abrasive member connected to the first end of the shaft member; and a second abrasive member connected to the second end of the shaft member, wherein the first and second abrasive members are provided with substantially teardrop configurations having substantially elliptical cross-sectional configurations.

15. The instrument of claim 14 wherein the first and second abrasive members are each provided with an outer peripheral surface having an abrasive material disposed thereon, the abrasive material being of substantially similar grade of coarseness.

16. The instrument of claim 14 wherein the first abrasive member is provided with an abrasive material of a different grade of coarseness than the abrasive material provided on the second abrasive member.

17. The instrument of claim 14 wherein the first and second abrasive members are each formed of a substantially uniform abrasive material of similar grade of coarseness.

18. The instrument of claim 14 wherein the first abrasive member is formed of a substantially uniform abrasive material of a different grade of coarseness than the grade of coarseness of the substantially uniform abrasive material of the second abrasive member.

19. A method for manicuring the underside of a fingernail comprising:

providing an instrument comprising:

a shaft member having a first end and a second end;

an abrasive member connected to at least one of the first and second ends of the shaft member, the abrasive member having a substantially arcuate shaped abrading surface sized and dimensioned for permitting at least a portion of the abrasive member to be positioned for abrading engagement with the underside of the fingernail so as to hone and file the underside of the fingernail;

positioning one of the abrasive member connected to one of the first and second ends of the shaft member adjacent an underside of the fingernail such that the abrasive member abradingly engages the underside of the fingernail;

imparting movement to the shaft member causing the abrasive member to abradingly engage the underside of the fingernail thereby producing an abrasive action on the underside of the fingernail; and removing the abrasive member from contact with the underside of the fingernail.

20. A method for manicuring the underside of a fingernail comprising:

providing an instrument comprising:

a shaft member having a first end and a second end;

an abrasive member connected to at least one of the first and second ends of the shaft member, the abrasive member having a substantially elliptical cross section and a pointed distal end to permit placement of the abrasive member underneath an outwardly extending portion of the fingernail whereby upon movement of the shaft member the abrasive member abrasively engages an underside of the fingernail to hone and file the underside of the fingernail;

positioning one of the first and second abrasive members adjacent an underside of the fingernail such that the abrasive member abradingly engages the underside of the fingernail;

imparting movement to the shaft member causing the abrasive member to abradingly engage the underside of the fingernail thereby producing an abrasive action on the underside of the fingernail; and removing the abrasive member from contact with the underside of the fingernail.

* * * * *